United States Patent [19]

Torczon

[11] Patent Number: 4,573,276

[45] Date of Patent: Mar. 4, 1986

[54] TOOL GUIDE

[76] Inventor: David J. Torczon, 714 N. 49th St., Omaha, Nebr. 68132

[21] Appl. No.: 447,780

[22] Filed: Dec. 20, 1982

Related U.S. Application Data

[63] Continuation-in-part of Ser. No. 281,948, Jul. 10, 1981, abandoned.

[51] Int. Cl.[4] ..... B43L 13/00

[52] U.S. Cl. ..... 33/481; 33/403

[58] Field of Search ..... 33/474–481, 33/201, 202, 403; 83/745

[56] References Cited

U.S. PATENT DOCUMENTS

| | | | |
|---|---|---|---|
| 660,876 | 10/1900 | West | 33/480 |
| 1,035,379 | 8/1912 | Miller | 33/403 |
| 2,735,455 | 2/1956 | Forsberg | 83/745 |
| 2,773,523 | 12/1956 | Hopla | 33/403 |
| 3,010,209 | 11/1961 | McKinley | 33/481 |
| 4,404,753 | 9/1983 | Klok | 33/474 |

*Primary Examiner*—Charles Frankfort
*Assistant Examiner*—Patrick R. Scanlon
*Attorney, Agent, or Firm*—Zarley, McKee, Thomte, Voorhees & Sease

[57] ABSTRACT

A tool guide for directing hand tools over a workpiece at an angle perpendicular to one edge of the workpiece is disclosed. The guide has two perpendicular legs equipped with flanges for aligning the guide and directing a hand tool along the guide. Measuring units are provided along surfaces of the guide to allow it to be used alternately as a carpenter's square and to facilitate carpentry operations without premeasuring. The flanges are shorter than the legs to provide cutouts for clamp removal and a cross brace enables the guide to be optionally stabilized without clamps.

1 Claim, 7 Drawing Figures

TOOL GUIDE

CROSS-REFERENCE TO RELATED APPLICATION

This is a continuation-in-part application of my previous U.S. patent application Ser. No. 281,948 filed July 10, 1981, now abandoned.

BACKGROUND OF THE INVENTION

The present invention relates generally to guides which may be used in carpentry and more particularly to a guide which may be used with power hand tools, such as routers and circular saws.

During carpentry operations, it is often necessary to cut a workpiece in a line perpendicular to one edge of the workpiece. A carpenter's square is often used to facilitate this operation by aligning one leg of the square with the edge of the workpiece and scribing a line at the desired location, using the other leg of the square as a guide. A cut or groove can then be made by following the line with a cutting tool. A problem with this method is that sawdust often obscures the line or the workman has trouble holding the saw or router in a straight line as it is pushed along.

A number of guides have been devised to eliminate the need for a scribe line. A guide provides a surface against which one edge of the hand tool may be positioned as it is pushed across the workpiece. However, for the most part, these guides have been difficult to use and often prove to be unreliable because of bending or loose joints which allows the guide surface to deviate from a true perpendicular alignment.

Past guides generally have included vertically protruding elements which prevent inversion of the guide in use. As a result, only one edge can be used for alignment with the workpiece and the other edge must always be used as the guide for the power tool, pencil or the like. One such guide is disclosed in Hopla, U.S. Pat. No. 2,773,523 wherein two guide members are pivotally connected in overlapped relation so as to lie in different horizontal planes. Another problem with existing tool guides is that the length of a cut must be premeasured with a carpenter's square before the cut is made, thus requiring two operations to make a single cut. Finally, prior guides have required clamping of the guides to the workpiece to assure that the guide is properly stabilized. Clamping is a tedious and time-consuming operation.

It can be seen that a need exists for a guide tool which is reliable and easy to use. The guide tool should contain measured markings which allow the user to make a cut without premeasuring the cut with a carpenter's square. A method for stabilizing the device relative to the workpiece should also be provided, which can accommodate use with or without clamps, to prevent any movement of the guide during precise cutting.

SUMMARY OF THE INVENTION

The present invention consists of a tool guide with an "L" shaped configuration similar to a carpenter's square. The tool guide is provided with flanges for aligning a leg of the guide with the edge of a workpiece. Measuring units are also provided along each surface of the guide to enable it to be used as a carpenter's square or to allow a precise cut to be made without premeasuring. Accordingly, it is an object of the present invention to provide an "L" shaped tool guide.

It is a further object of the present invention to provide a guide with flanges for aligning the guide with the edge of a workpiece.

It is a further object of the present invention to provide a guide with measured markings.

It is a further object of the present invention to provide a guide of simple and integral construction.

It is a further object of the present invention to provide a guide with a raised tool guiding flange.

It is a further object of the present invention to provide a guide with spaces provided for clamping.

It is a further object of the present invention to provide a guide which may be used with a circular hand saw.

It is a further object of the present invention to provide a guide which may be used with a router.

It is a further object of the present invention to provide a guide which may be used with a reciprocating saw.

It is a further object of the present invention to provide a guide which has a combination handle and tool alignment surface.

It is a further object of the present invention to provide a guide which may be used alternately as a carpenter's square.

It is a further object of the present invention to provide a guide which has a surface ridge which may be used as a handle guide.

It is a further object of the present invention to provide a guide which may be constructed in left handed or right handed models.

It is a further object of the present invention to provide a guide which is inexpensive to produce.

It is a further object of the present invention to provide a guide which is easy to hold in alignment, either with or without clamps.

It is a further object of the present invention to provide a guide which is safe to use.

DESCRIPTION OF THE PREFERRED EMBODIMENT

Figure 1:
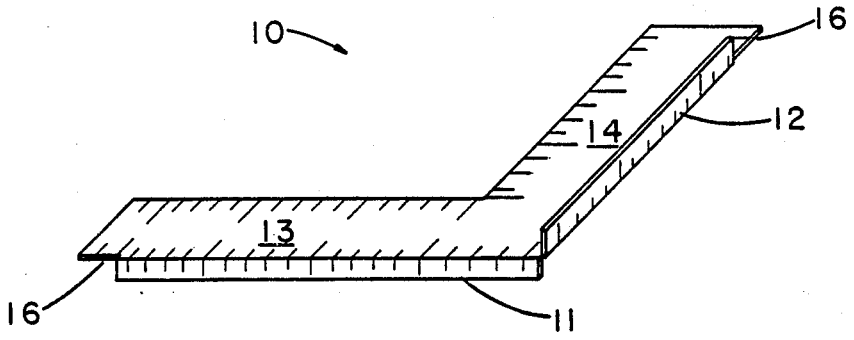
FIG. 1 is a perspective view of a hand tool guide.
Figure 2:
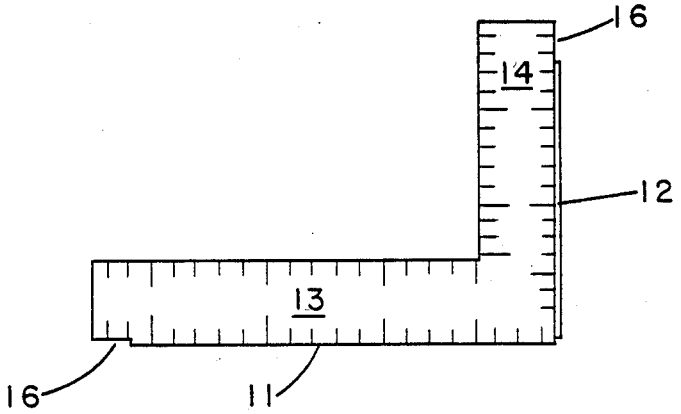
FIG. 2 is a top view of the hand tool guide of FIG. 1.
Figure 3:
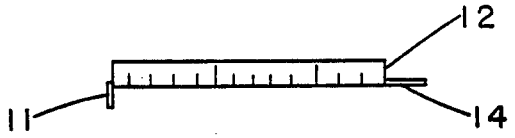
FIG. 3 is a right side elevation view of the hand tool guide of FIG. 1.
Figure 4:
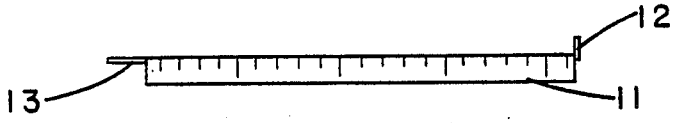
FIG. 4 is a front elevation view of the hand tool guide of FIG. 1.

It can be seen from FIG. 1 that the tool guide has an "L" shaped configuration similar to a carpenter's square. In the preferred embodiment, tool guide 10 is integrally formed from a single sheet of rolled metal. The two legs of the "L" 13, 14 intersect at right angles in the preferred embodiment, although tool guides 10 could be produced in any desired angular configuration. An alignment flange 11 is formed by bending a metal strip at right angles to the surface of the alignment leg 13. A guide flange 12 is similarly constructed from a metal strip associated with a guide leg 14. However, the guide flange 12 is vertically directed in the opposite direction from the alignment flange 11. Thus, it can be seen that when the tool guide 10 is positioned so that the guide flange 12 is in an upward position, the alignment flange 11 is directed downward and vice versa.

Figure 6:
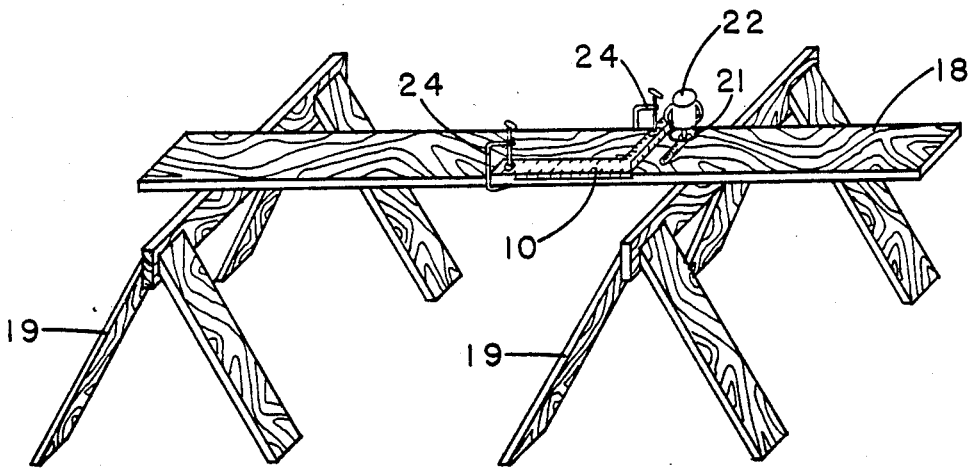
FIG. 6 is a perspective view of a hand tool guide clamped onto a workpiece and used to guide a router.

As seen in FIGS. 1 and 6, the first elongated strip or alignment flange 11 and second elongated strip or guide flange 12 are of shorter length than the associated first and second scribe edges of legs 13 and 14 respectively, thereby to provide cutouts to facilitate clamping of said tool guide to a workpiece which is thinner than the width of said first and second elongate strips. These cutouts are identified in the drawing by reference numeral 16. Were it not for these cutouts, hold down clamps such as indicated by reference numeral 24 in FIG. 6 would always have to be open to the full extent of the width of the alignment flange 11 or it must be slid lengthwise along alignment leg 13 until clearing the end of flange 11 to remove the clamp from the tool guide and workpiece. This applies whenever the workpiece has a thickness which is less than the width of the alignment flange 11. To the contrary, the cutouts 16 permit the clamp to simply be loosened and removed directly without longitudinal sliding movement of the clamp or opening the clamp to a sufficient extent to clear the flange 11.

Figure 5:
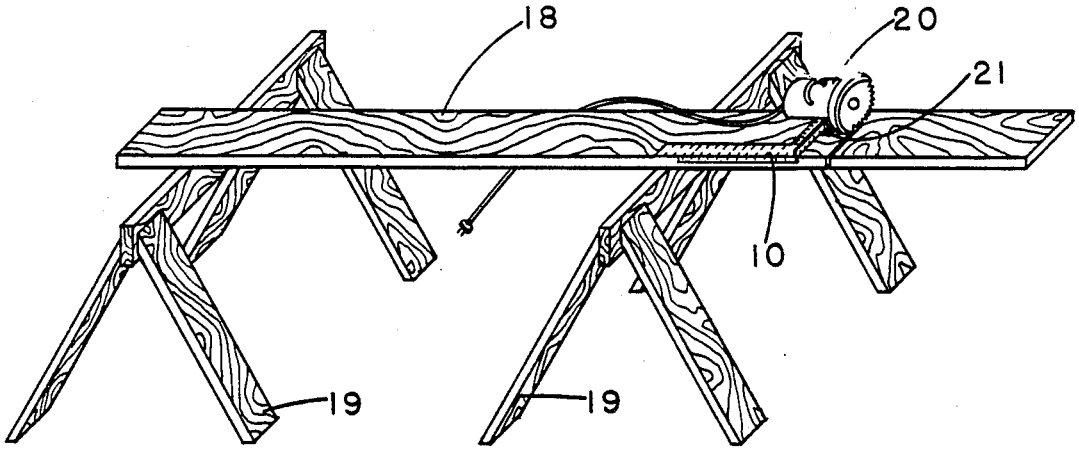
FIG. 5 is a perspective view of a hand tool guide used for guiding a circular saw.

To use the tool guide 10, a carpenter places the tool guide 10 on the workpiece 18 and aligns the alignment flange 11 with the edge of the workpiece 18, as shown in FIGS. 5 and 6. A hand tool, such as a circular saw 20, as shown in FIG. 5 or a router 22, as shown in FIG. 6, may then be directed along the guide flange 12 to make a cut perpendicular to the edge of the workpiece 18. A rectangular base plate 21 of the hand tool 20 is placed in sliding contact with the guide flange 12 to provide guidance for the tool 20, 22. Since the motor portion of a circular saw 20 would extend out over the guide leg 14, it is necessary to restrict the height of the guide flange 12 to provide clearance for the motor and housing.

As shown by FIGS. 1 through 4, the peripheral edges of the "L", hereinafter referred to as scribe surfaces, have measured markings which may be used to measure distances in the same number as a conventional carpenter's square. The flange portions 11, 12 are also provided with measured markings. Thus, it may be seen that a person making a cut could use the markings on the guide flange 12 to make a cut of a measured distance without first resorting to measuring out and marking the distance on the workpiece 18. The measured markings also allow the tool guide 10 to be used essentially interchangeable with a conventional carpenter's square.

As illustrated in FIGS. 1 through 4, one leg of the "L", in this configuration the alignment leg 13, is longer than the other leg. However, when it is desired to use the longer leg and the associated flange as a guide surface, it is only necessary to turn the tool guide 10 over. The alignment flange 11 then serves as a guide flange and the guide flange 12 becomes an alignment flange. It may also be seen that in the embodiment shown in FIGS. 1 through 4, a hand tool 20, 22 will always be positioned to the right side of the guide flange 12, whether the tool guide 10 is used in the position shown or in the inverted position. A mirror image model of the tool guide, shown in FIGS. 1 through 4, could be produced to provide a "left-handed" tool guide 10.

Figure 7:
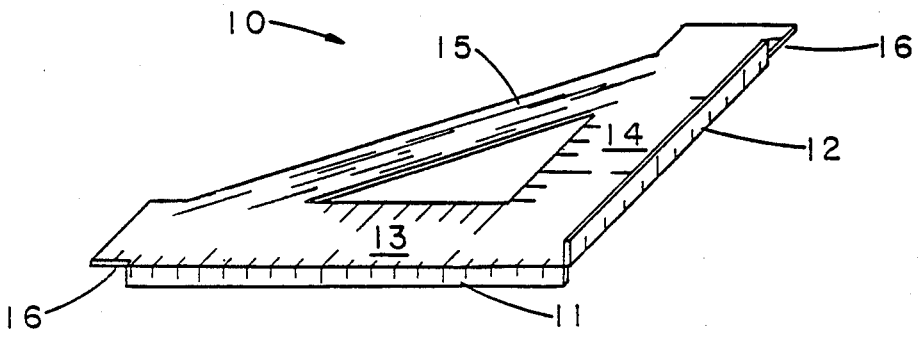
FIG. 7 is a perspective view of yet another embodiment of a hand tool guide.

As shown by FIG. 7, a cross brace 15 may be added to stabilize the guide relative to a workpiece without the use of any clamps. The brace 15 is preferably integrally formed with legs 13 and 14 so that the entire tool guide can be quickly and easily formed in a simple two-step stamping and bending operation.

The cross brace 15 is formed substantially coplanar with the legs 13 and 14 so that the tool guide is substantially free of elements situated above and below the legs 13 and 14 other than the first and second elongated strips or flanges 11 and 12. There are several advantages of this coplanar feature. First, the device may be used more simply and conveniently since either the upper or lower surface of the legs may face upwardly and either flange may serve as either the alignment flange or guide flange. Secondly, depending upon space limitations and dimensions of the workpiece, it is sometimes more desirable to use the shorter leg or the longer leg for the alignment flange. Thus the present invention affords a freedom of choice unavailable with the prior art devices.

In use, once a selected flange is engaged along one edge of a workpiece as the alignment flange, the operator need only press down on cross brace 15 with one hand while pressing his thigh against the alignment flange to stabilize the tool guide without any clamps. Whereas clamping may be preferred for precision work where the tolerances are extremely tight, repetitive work can be accomplished much faster and easier without clamping. The present invention thus affords a stabilizing capability both with and without clamps. The simplicity of the present tool guide thus results in a flexibility and versatility of use which distinguishes it from all known tool guides.

Although specific components and steps have been stated in the above description of the preferred embodiments of the invention, other suitable materials, and process steps may be used with satisfactory results with varying degrees of quality. In addition, it will be understood that various other changes of the nature of the invention will occur to and may be made by those skilled in the art, upon the reading of this disclosure. Such changes are intended to be included within the principles and scope of this invention as claimed.

I claim:

1. A tool guide for directing hand tools over a workpiece comprising:

(a) integrally formed right angle base plate means comprising an integeral generally rigid "L" shaped carpenter's square having first and second legs;

(b) first guide means operably attached to said first leg for aligning said base plate means with a workpiece; and (c) second guide means operably attached to said second leg for guiding a hand tool over said workpiece, said right angle base plate means comprising upper and lower surfaces, a first elongate scribe edge along said first leg and a second elongate scribe edge along said second leg positioned in perpendicular relation to said first scribe edge, said first guide means comprising a first elongate strip operably protruding from the lower surface of said base plate means in longitudinal alignment with said first elongate scribe edge, said second guide means comprising a second elongate strip operably protruding from the upper surface of said base plate means in longitudinal alignment with said second scribe edge, said first and second elongate strips being of shorter length than said first and second scribe edges respectively thereby to provide cutouts to facilitate clamping of said tool guide to a workpiece which is thinner than the width of said first and second elongate strips, and a cross brace connected to and extending between said first and second legs, said cross brace being substantially coplanar with said first and second legs, said tool guide being free of elements situated above and below said base plate means other than said first and second elongate strips whereby said tool guide is adapted for use with either the upper or lower surface of the base frame means facing upwardly.

* * * * *